US007140428B2

(12) United States Patent
Campo

(10) Patent No.: US 7,140,428 B2
(45) Date of Patent: Nov. 28, 2006

(54) EXPANDER FOR EXPANDING A TUBULAR ELEMENT

(75) Inventor: Donald Bruce Campo, Richmond, TX (US)

(73) Assignee: Shell Oil Company, Houston, TX (US)

( * ) Notice: Subject to any disclaimer, the term of this patent is extended or adjusted under 35 U.S.C. 154(b) by 146 days.

(21) Appl. No.: 10/795,894

(22) Filed: Mar. 8, 2004

(65) Prior Publication Data

US 2005/0194128 A1 Sep. 8, 2005

(51) Int. Cl.
*E21B 23/00* (2006.01)

(52) U.S. Cl. ..... 166/55; 166/216; 166/381; 72/370.08

(58) Field of Classification Search ..... 166/55, 166/55.1, 207, 216, 217, 242.1, 316, 380, 166/381, 384; 72/393, 370.08, 353.4, 353.2
See application file for complete search history.

(56) References Cited

U.S. PATENT DOCUMENTS

| | | | | |
|---|---|---|---|---|
| 1,494,128 | A | 5/1924 | Primrose | |
| 1,982,400 | A | 11/1934 | Reimenschneider et al. | 29/153.1 |
| 2,357,123 | A | 8/1944 | Maxwell | 153/80.5 |
| 3,023,178 | A | 6/1962 | Greenlee et al. | 260/22 |
| 3,067,801 | A | 11/1962 | Sortor | 153/80 |
| 3,191,680 | A | 6/1965 | Vincent | 166/46 |
| 3,712,376 | A * | 1/1973 | Owen et al. | 166/277 |
| 4,262,518 | A | 4/1981 | Creger et al. | 72/393 |
| 5,785,120 | A * | 7/1998 | Smalley et al. | 166/55 |
| 6,012,523 | A * | 1/2000 | Campbell et al. | 166/277 |
| 6,098,717 | A | 8/2000 | Bailey et al. | 166/382 |
| 6,450,261 | B1 * | 9/2002 | Baugh | 166/277 |
| 6,460,615 | B1 | 10/2002 | Heijnen | 166/55 |
| 6,557,640 | B1 | 5/2003 | Cook et al. | 166/380 |
| 6,568,472 | B1 | 5/2003 | Gano et al. | 166/157 |
| 6,622,789 | B1 | 9/2003 | Braddick | 166/277 |
| 6,688,397 | B1 | 2/2004 | McClurkin et al. | 166/380 |
| 6,691,777 | B1 * | 2/2004 | Murray et al. | 166/216 |
| 6,722,427 | B1 | 4/2004 | Gano et al. | 166/217 |
| 2002/0033262 | A1 * | 3/2002 | Musselwhite et al. | 166/285 |
| 2002/0104647 | A1 | 8/2002 | Lawrence | 166/55.1 |
| 2003/0075339 | A1 | 4/2003 | Gano et al. | 166/380 |
| 2003/0150608 | A1 | 8/2003 | Smith, Jr. et al. | 166/118 |

(Continued)

FOREIGN PATENT DOCUMENTS

EP 1306519 A2 5/2003

(Continued)

OTHER PUBLICATIONS

Search Report dated Aug. 3, 2005.

(Continued)

*Primary Examiner*—David Bagnell
*Assistant Examiner*—Daniel P Stephenson
(74) *Attorney, Agent, or Firm*—Rachael Stiegel

(57) ABSTRACT

A duplex expansion apparatus for expanding a wellbore tubular to two different diameters from an initial diameter is provided. The duplex expansion apparatus includes: a first diameter expansion cone that is, in a relaxed state, of a diameter less than the internal diameter and in an expanded state of a diameter greater than the internal diameter; a second diameter expansion cone that is, in a relaxed state, of a diameter less than the internal diameter and in an expanded state of a diameter greater than the diameter of the first diameter expansion cone in the expanded state; and an assembly mandrel that is capable of transferring both the first diameter expansion cone and the second diameter expansion cone into their expanded states.

17 Claims, 10 Drawing Sheets

U.S. PATENT DOCUMENTS

| | | | | |
|---|---|---|---|---|
| 2003/0178204 | A1 | 9/2003 | Echols et al. | 166/386 |
| 2003/0192703 | A1 | 10/2003 | Williams et al. | 166/376 |
| 2004/0159446 | A1 | 8/2004 | Haugen et al. | 166/384 |
| 2004/0168796 | A1* | 9/2004 | Baugh et al. | 166/207 |
| 2005/0056433 | A1* | 3/2005 | Ring et al. | 166/384 |

FOREIGN PATENT DOCUMENTS

| | | | |
|---|---|---|---|
| GB | 2392686 | A | 3/2004 |
| GB | 2401131 | A | 3/2004 |
| GB | 2398312 | A | 8/2004 |
| GB | 2399848 | A | 9/2004 |
| GB | 2392686 | A | 10/2004 |
| WO | A-93/25800 | | 12/1993 |
| WO | 02/23007 | A1 | 3/2002 |
| WO | 03/023178 | A2 | 3/2002 |
| WO | 02/29199 | A1 | 4/2002 |
| WO | 02/053867 | A2 | 7/2002 |
| WO | 02/086286 | | 10/2002 |
| WO | 02/29199 | A1 | 11/2002 |
| WO | 03/006788 | A1 | 1/2003 |
| WO | 03/015954 | A1 | 2/2003 |
| WO | 03/16669 | A2 | 2/2003 |
| WO | 03/023178 | A2 | 3/2003 |
| WO | 03/066788 | A1 | 8/2003 |
| WO | 03/069115 | A2 | 8/2003 |
| WO | WO 2003069115 | A2 * | 8/2003 |
| WO | 2004/007892 | A2 | 1/2004 |
| WO | 2004/079150 | A2 | 9/2004 |
| WO | 2004/079157 | A1 | 9/2004 |
| WO | 2004/081346 | A2 | 9/2004 |

OTHER PUBLICATIONS

Written Opinion of the ISA dated Aug. 3, 2005.
International Search Report dated Aug. 3, 2005.
Written Opinion dated Aug. 3, 2004.
International Search Report dated Aug. 3, 2005.
U.S. Appl. No. 10/382,325.
Appl. No. 10/795,841, Office Action dated Jun. 16, 2005.
Appl. No. 10/795,664, Office Action dated Oct. 4, 2005.
Appl. No. 10/795,951, Office Action dated Jun. 16, 2005.
TH2655 PCT International Search Report dated Jul. 4, 2006.

* cited by examiner 230
101
222
219
216
215
215
103
205
108
112
119

230
101
222
219
216
215
215
220
205
901
212
211
209
203

EXPANDER FOR EXPANDING A TUBULAR ELEMENT

FIELD OF THE INVENTION

The invention relates to an expander for radially expanding a tubular element by axial movement of the expander through the tubular element, and to a method of radially expanding a tubular element.

BACKGROUND TO THE INVENTION

Radial expansion of tubular elements has been applied, for example, in wellbores whereby a tubular casing is lowered into the wellbore in unexpanded state through one or more previously installed casings. After the casing is set at the required depth, an expander is moved through the casing to radially expand the casing to an inner diameter which is about equal to the inner diameter of the previously installed casing. In this manner it is achieved that the inner diameters of subsequent casings are about equal as opposed to conventional casing schemes which have stepwise decreasing casing diameters in downward direction. For example, WO-A-93/25800 teaches expansion of a casing in a wellbore by a solid expansion mandrel, the mandrel being pulled through the tubular or hydraulically pushed through the casing.

Expansion of tubulars is discussed in, for example, U.S. Pat. No. 6,557,640, and published U.S. patent application Ser. No. 10/382,325, the disclosures of which are incorporated herein by reference.

Expandable expansion cones are suggested, for example, in U.S. Pat. No. 6,460,615 the disclosure of which is incorporated herein by reference. Expansion of a cone within a casing requires that the casing be expanded as the expansion cone is expanded. This requires considerably more force than the force needed to pull a mandrel through the casing once the cone has been expanded. Further, if the lower casing is to overlap the previously installed casing and the inside diameter of the final casing is to remain constant through the overlap section, then the overlap section of the upper casing needs to be expanded by more than the remainder of the casing. Some provision for this greater expansion also needs to be provided.

SUMMARY OF THE INVENTION

According to one aspect of the present invention, a duplex expansion apparatus for expanding a wellbore tubular to two different diameters from an initial diameter, the duplex expansion apparatus comprising: a first diameter expansion cone that is, in a relaxed state, of a diameter less than the internal diameter and in an expanded state of a diameter greater than the internal diameter; a second diameter expansion cone that is, in a relaxed state, of a diameter less than the internal diameter and in an expanded state of a diameter greater than the diameter of the first diameter expansion cone in the expanded state; and an assembly mandrel that is capable of transferring both the first diameter expansion cone and the second diameter expansion cone into their expanded states.

DETAILED DESCRIPTION

In this specification, a tubular to be expanded is referred to as a casing, but it is to be understood that the term casing is meant to include any tubular to be expanded. A open hole liner or other wellbore tubular may be expanded by the methods and apparatuses described and claimed herein. The expansion apparatus of the present invention is referred to as a duplex expansion apparatus or mandrel because the apparatus can be used for expansion of a larger bell at the bottom of a casing, plus the remainder of the casing to a somewhat smaller diameter. The difference between the inside diameter of the bell compared to the remainder of the casing can be between about 0.2 and about 1.5 inches, or it could be about 0.5 inches. The difference in diameter can be about twice the expanded thickness of a casing to be expanded in the next lower section of the wellbore. The duplex expansion apparatus could be arranged to first expand the upper portion of the casing, and then converted to a larger diameter mandrel and used to expand the bell. Alternatively, and as shown in the apparatus discussed below, the apparatus could be configured to expand the bell first, and then contracted to a smaller diameter mandrel, but still a larger diameter than the unexpanded casing, and then used to expand the rest of the casing.

Figure 1:
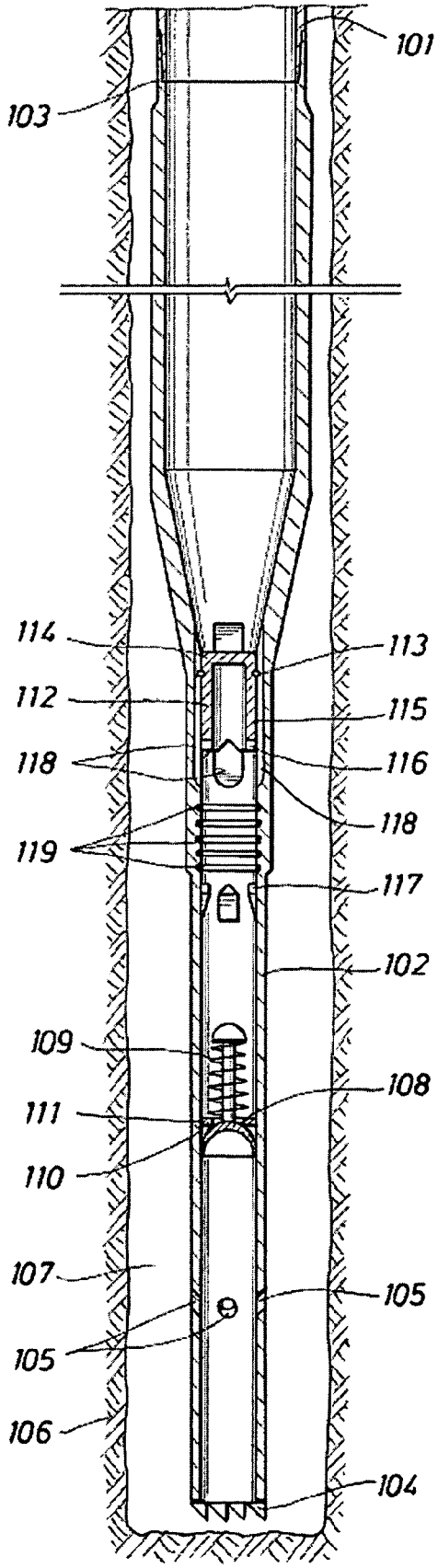
FIG. 1 is a partial cross sectional view of a lower end of an expandable casing and cement shoe.

Referring now to FIG. 1, a lower end of an expandable casing 101 with a cement shoe 102 is shown. A threaded joint 103 is provided to connect an aluminium cement shoe with the expandable casing 101. The joint is a pin-down joint to permit downward expansion without the threads spreading due to the expansion of the upper section before the lower section. The entire shoe is aluminium or another millable or drillable material so that it can be readily removed for drilling of a subsequent open hole interval. The subsequent open hole interval may then be cased or left uncased. The cement shoe includes a bottom which preferably has teeth 104 to enhance opening of a hole if it has partially closed in the time interval between drilling and insertion of the expandable casing and secure the casing against rotation. Ports 105 are provided to ensure that cement can exit the cement shoe to an annulus between the casing 101 and formation 106 through which the wellbore 107 is drilled. The cement shoe includes a check valve 108 to keep cement from backing up into the casing once the cement has been placed in the wellbore by pumping through the casing. In this embodiment, the check valve includes a spring 109 that urges a valve seat 110 upward to close against a fixed valve seat 111. Millable check valves and complete millable cement shoes are commercially available from many sources.

The cement shoe of the embodiment shown includes a sliding valve 112 for sealing the cement shoe for upward expansion of the expandable casing. The sliding valve 112 is shown in an open position in FIG. 1. The sliding valve is held in an open position by a snap ring 113. The sliding valve has a top 114 sealed to a cylindrical section 115. The bottom of the sliding valve preferably has engaging teeth 116 for engaging with seat teeth 117 for holding the sliding valve in a fixed position when the valve is transferred to a closed position. In the open position slots 118 allow fluids to bypass the sliding valve for circulation through the casing and into the wellbore. Seals 119 are shown for providing a good seal against the cylindrical section of the sliding valve after the sliding valve has been transferred to a closed position.

The bottom of the casing is shown in FIG. 1 in a configuration in which it is inserted into the wellbore. Cement is circulated through the casing into the wellbore in this configuration.

Figure 2A:
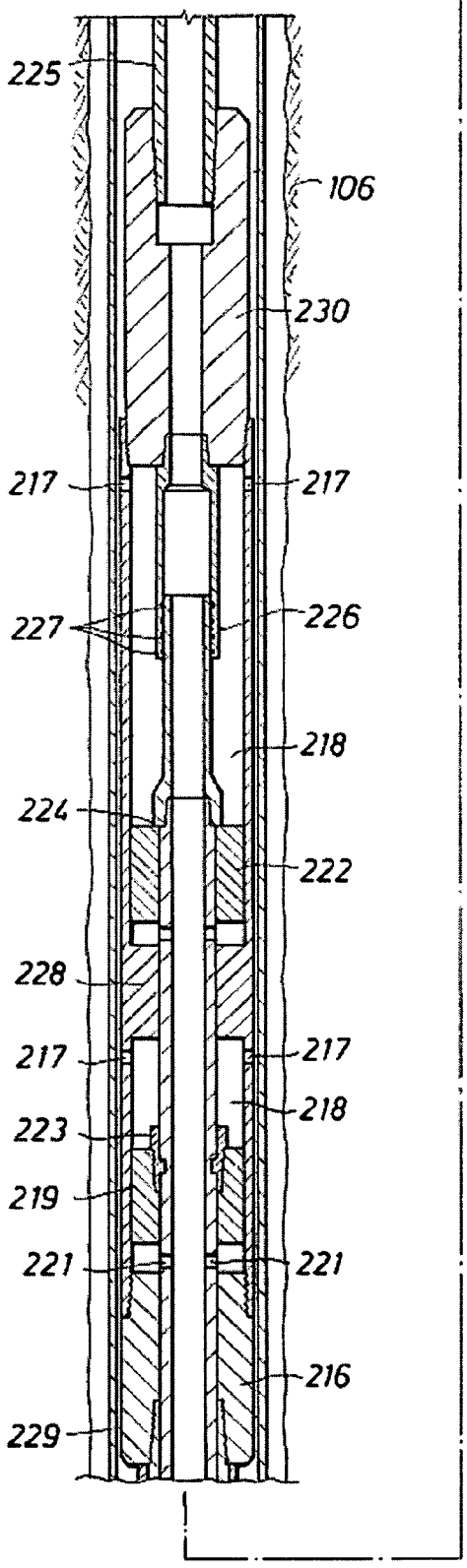
FIGS. 2A and 2B are partial cross sectional views of an expandable casing and an unexpanded duplex expansion cone within the expandable casing.
Figure 2B:
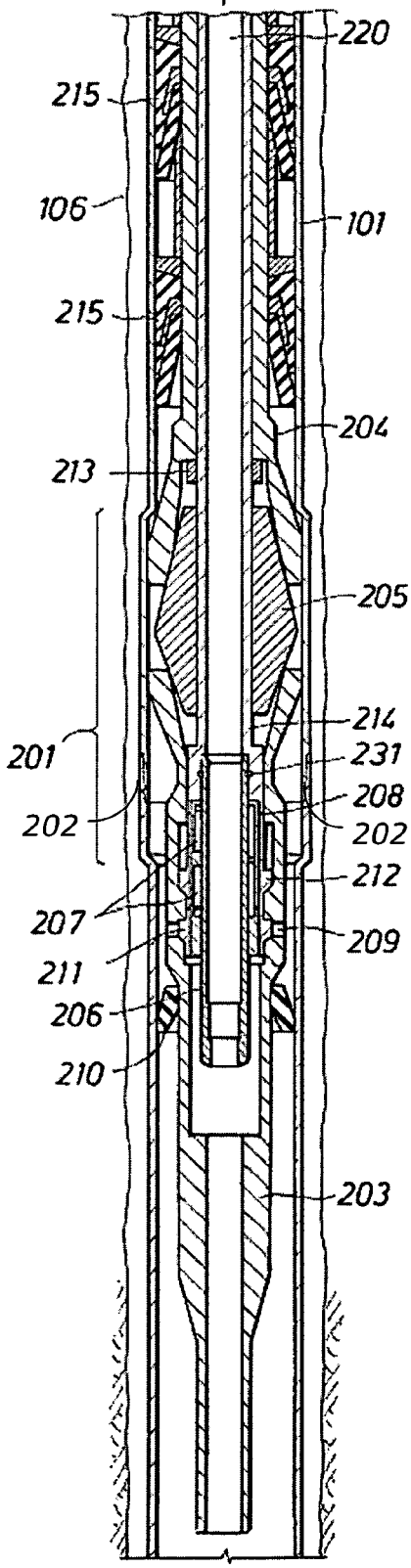

Referring now to FIGS. 2A and 2B, a duplex expansion mandrel is shown within an expandable casing in a configuration in which the duplex mandrel is inserted into a wellbore within a formation, 106. This apparatus, including the expandable casing, may be inserted into the wellbore through a casing in an upper section of the wellbore, the casing having been previously expanded by an expansion apparatus of the same design as the apparatus being inserted. Thus the final cased wellbore could have the same diameter from top to bottom, or through a plurality of different cased intervals.

The expandable casing preferably has a preexpanded section 201 within which the duplex cone is placed. The preexpanded section has been expanded by about, for example a half-inch diameter increase. This relatively short section of preexpanded casing is still of a smaller outside diameter than the inside diameter of the expanded casing, by for example 0.1 to 1.2 inches to permit insertion through a previously expanded casing. It is not desirable to have an extended length of preexpanded casing because a small clearance between the external surface of the preexpanded casing and the internal surface of an expanded casing would make insertion of the casing through an expanded casing problematic. But a short section of a relatively small clearance does not create significant problems when inserted through a previously expanded casing. The casing can be placed into the wellbore suspended from a collapsed upper expansion cone 204. The collapsed upper expansion cone 204 has an outer diameter larger than the inside diameter of the unexpanded casing above the preexpanded section 201.

A threaded joint 202 is preferably provided in the preexpanded section and this joint is preferably the only joint in the bell section of the expanded casing. This threaded joint allows the casing to be joined around the duplex expansion cone. Alternatively, additional joints in the bell section of the expanded casing could also optionally be preexpanded. Having joints in the bell section of the expanded casing being preexpanded reduces the expansion force required for expansion of the joints to the larger diameter. Because more force is required to expand joints, and more force is required to expand casing to a larger diameter, preexpansion of joints in the bell section is desirable because it would otherwise require additional expansion force compared to the remainder of the casing.

The duplex cone includes a lower cone 203, an upper cone 204, and expansion die 205, all assembled on an assembly mandrel 214. The assembly mandrel pulls and pushes the two cones over the die to expand the duplex cone.

In the configuration shown in FIGS. 2A and 2B, fluids may pass through the center of the unexpanded duplex cone assembly. A flow tube 206 hold flapper valves 207 open within a flapper valve assembly 208. The flapper valve assembly also provides a seal for lower cone ports 209 in this initial configuration of the duplex cone assembly.

Wipers 210 are shown attached to the lower cone assembly for keeping the casing clean prior to expansion by the duplex cone.

The lower cone is held by the assembly mandrel in an initial position by first dogs 211. Second dogs 212 will later hold the cone in a second position with respect to the assembly mandrel. A spacer 213 is shown between the expansion die and the upper cone 204. Seal assemblies 215 are attached to the upper cone to aid in upward expansion. The pulling assembly and the upper cone are in fixed relationship to each other, and in a movable relationship to the assembly mandrel. The pulling assembly may have a plurality of pulling chambers 218, two are shown, containing a lower piston 219 and an upper piston 222. The pulling chambers 218 are in fluid communication with a flow path 220 through the assembly mandrel 214 through high pressure ports 221. The lower pistons movement with respect to the assembly mandrel 214 is shown to be limited by retainer tie 223. Movement of the upper piston 222 with respect to the assembly mandrel 214 is shown to be limited by the shoulder of pin box 224.

Vent ports 217 maintain fluid communication between low pressure sides of the pulling chambers 218 and an annulus around the pulling assembly and the expandable casing 101. Thus when there is a pressure differential between the flow path 220 and the annulus around the pulling assembly 216, this pressure will be translated into force pulling the bottom expansion cone and pushing the upper expansion cone over the expansion die to form an expanded duplex cone. The assembly mandrel is movable with respect to the pulling assembly, and the pulling assembly is shown in a fixed relationship to a drill string 225. As the term is used in this description, the drill string is generally a typical string of pipes used for circulation of drilling muds while transmitting rotating forces to a drill bit, but in the practice of the present invention, additional features may be included in segments of the drill string, and segments could be utilized that differ from the segments typically used while drilling the wellbore. The flow path from the drill string through the assembly mandrel is passed through a flow path seal 226 which maintains a sealed and sliding relationship between the pulling assembly and the assembly mandrel. Seals such as o-rings 227 could be provided to improve the sealing relationship. To enable assembly, the pulling assembly could be constructed of a middle section, 228, a lower head, 229, and an upper head 230, with the three sections connected by two threaded connections, both of the threaded connections preferably in lower pressure segments of the pulling chambers.

In the configuration shown in FIGS. 2A and 2B, is the configuration in which the expandable cone is lowered into the wellbore, preferably through previously expanded casing. In this configuration there is no significant pressure differential between the flow path 220 and the annulus between the pulling assembly and the expandable casing 101. The number of pulling chambers and pistons may be chosen to have ample force to expand the duplex cone even while expanding the casing around the duplex cone.

Figure 3:
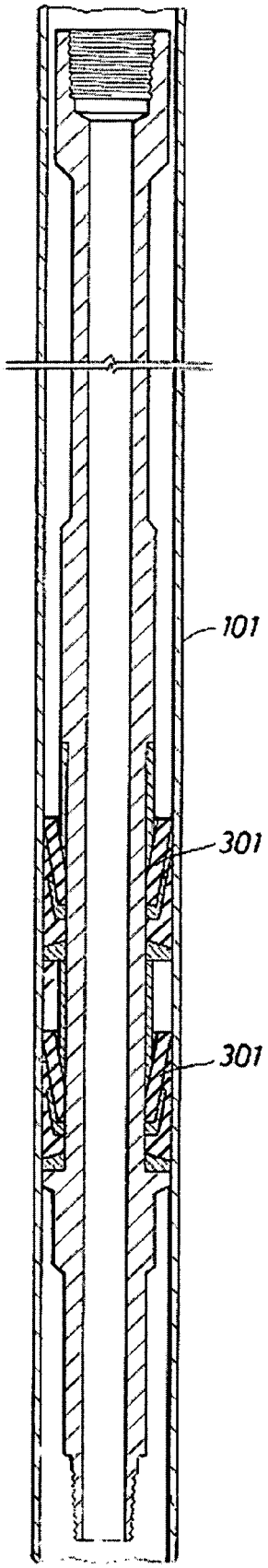
FIG. 3 is a partial cross sectional view of an expandable casing and a sealing assembly within the expandable casing.

Referring now to FIG. 3, a sealing assembly section is shown. The sealing section is in the drill string above the pulling assembly 216, and within the expandable casing 101. The sealing section includes seals 301 for maintaining force for downward expansion by the duplex cone. The seals may be, for example, Giberson cup packers available from Halliburton, of Ducan Okla. Two of the seals are shown but either one or a plurality may be provided as needed for effective sealing during the downward expansion.

Figure 4:
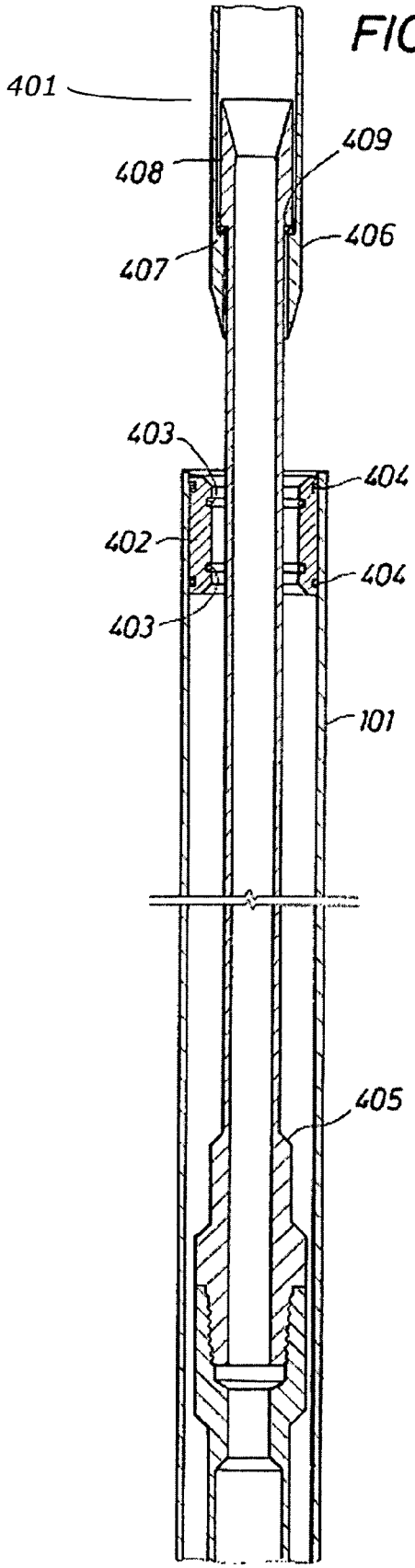
FIG. 4 is a partial cross sectional view of a top end of an expandable casing and an upper sealing assembly.

Referring now to FIG. 4, an upper end 401 of an expandable casing 101 is shown. The upper end of the expandable casing is fitted with bushing 402 for sealing for downward expansion. The bushing is removable and therefore preferably placed at the top of the expandable casing so that it will not have to slide out a great length of the expandable casing upon removal of the bushing. The bushing is preferably equipped with inside seals 403 and casing seals 404. FIG. 4 shows a configuration in which the casing is inserted into the wellbore, with communication between the annulus between the drill string 225 and the expandable casing 101 and the wellbore above the expandable casing 101. The bushing is notched (not shown) in the bottom so that a corresponding fin 405 in the first drill string box can catch the bushing, and remove it by twisting it out of the upper casing. Two opposing fins are shown in FIG. 4. Removal of the bushing allows for clearance for joint tools and the duplex expansion assembly above the expansion cone. The purpose of the bushing is to provide a seal for downward expansion. The seal is provide between the inside surface of the bushing and the outside surface of a slidable section of drill string 406. While the expandable casing and duplex cone assembly is suspended from the drill string, the weight of the casing and duplex cone assembly rests on slidable section shoulder 407, and rotational forces can be transferred through splined section 408. Flowpath seal 409 is provided so that leakage from the drill string flow path and the wellbore outside of the drill string is prevented.

Figure 5A:
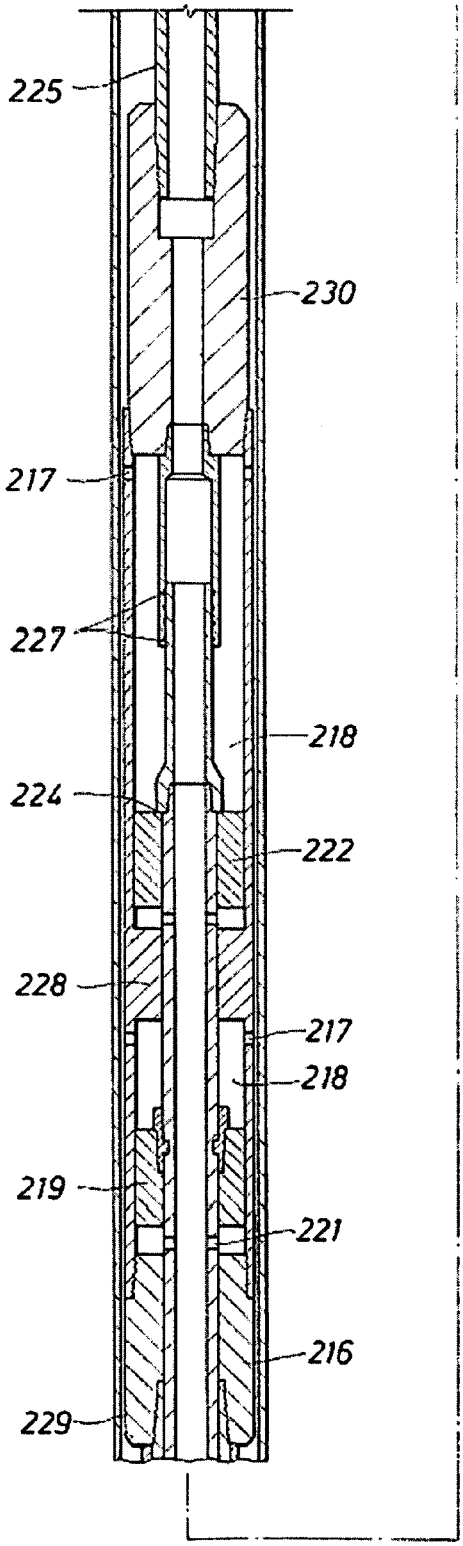
FIGS. 5A and 5B are partial cross sectional views of an expandable casing and an unexpanded duplex expansion cone within the expandable casing.
Figure 5B:
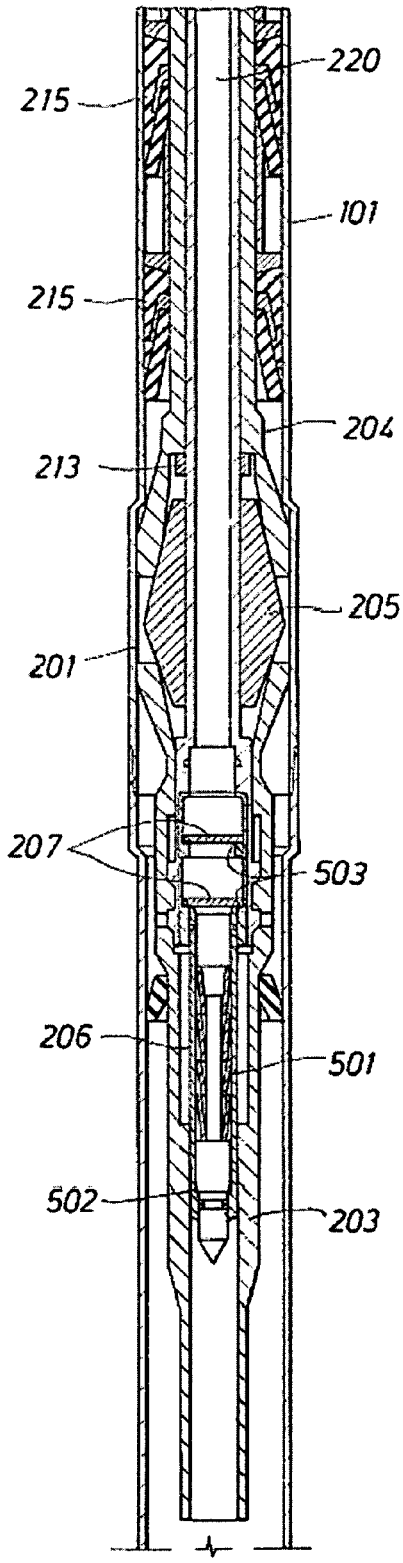

Referring now to FIGS. 5A and 5B, with previously mentioned elements numbered as in previous figures, the duplex cone is shown in an unexpanded position configured to be expanded upon pressurization of the flowpath within the assembly mandrel. This configuration is accomplished by inserting dart 501, which is stopped in flow tube 206. Although a dart is shown to be of an elongated shape, a ball or another shape could be utilized. The flow tube could be held in the initial position by a shear pin or a snap ring 231 that yields upon downward force being applied to the flow tube. The dart 501 includes a seal section 502 that seals inside of the flow tube, and the flapper valve 207 seals against the flapper valve seat 503 above the flow tube. After the flow tube 206 moves to the lower position, flapper valves 207 close. An advantage of the embodiment shown is that the flapper valve, including the seats for the valve, are protected by the flow tube from circulating fluids and cements prior to insertion of the dart 501. Thus, they are clean and more likely to seal. The flapper valves 207 are therefore primary seals, but seals between the flapper assembly and the flow tube, and the flow tube and the dart provide secondary seals for sealing the inside of the flow path to permit expansion of the duplex cone.

Figure 6A:
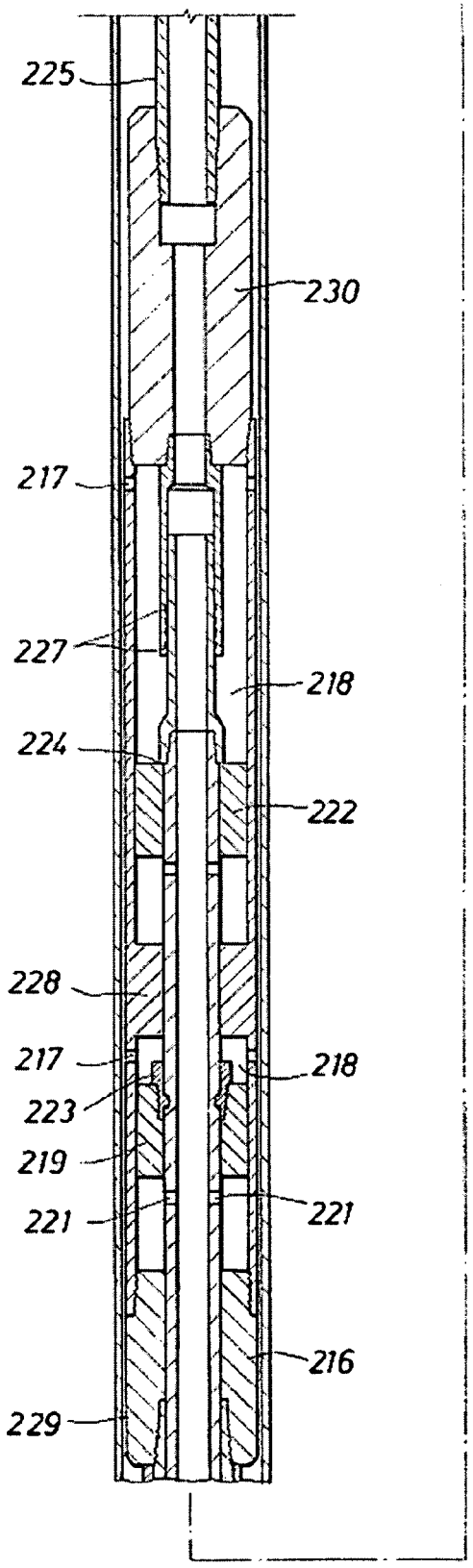
FIGS. 6A and 6B are partial cross sectional views of an expandable casing and an expanded duplex expansion cone which has been prepared for expansion within the expandable casing.
Figure 6B:
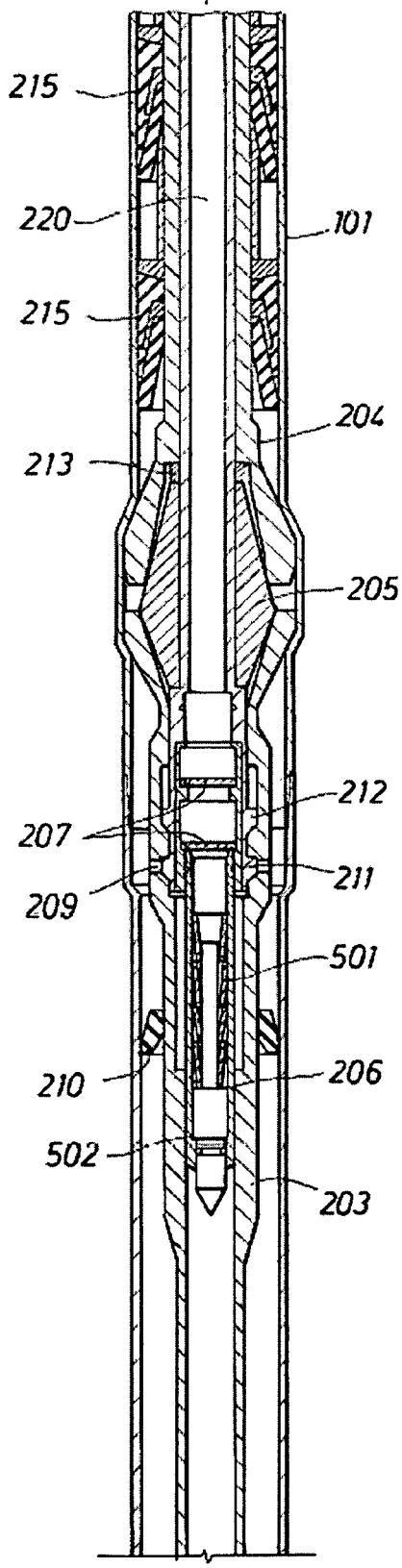

Referring now to FIGS. 6A and 6B, the duplex cone within an expandable casing is shown with the duplex cone forced into an expanded position. This expanded position is achieved by over pressuring the fluids in the drill string with respect to the fluids outside of the drill string and forcing the pistons 219 and 222 into upper positions within the pulling chambers 218.

Figure 7:
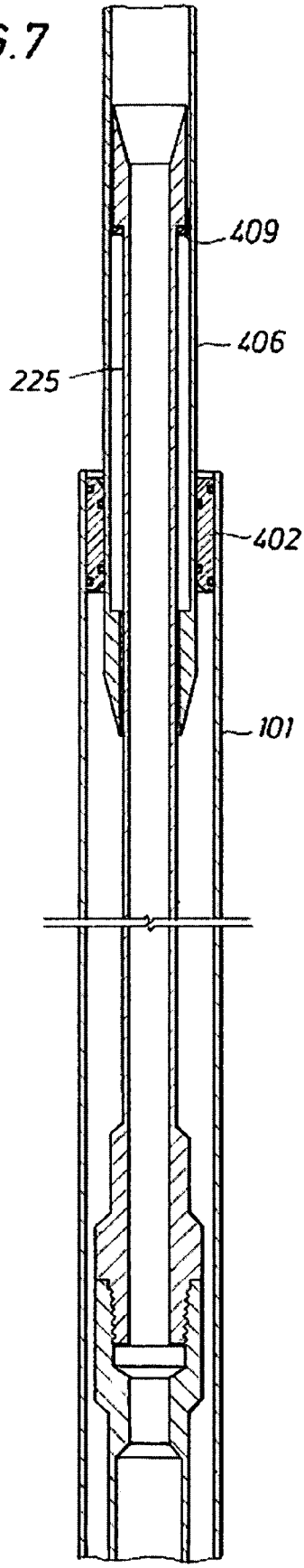
FIG. 7 is a partial cross sectional view of a top end of an expandable casing and an upper sealing assembly set in a position for downward expansion by the duplex cone.

Referring now to FIG. 7, the top end of the expandable casing is shown configured for downward expansion of the casing. After expansion of the duplex cone, the cone is supported by the casing at the point it is expanded, and the casing can be set on the bottom of the wellbore. The drill string can therefore be lowered to engage the slidable section of the drill string 406 into the bushing 402. This is the position shown in FIG. 7. The slidable section shoulder 407, when separated from the flow path seal 409, has ports for communication of fluid from within the drill string to the annulus around the drill string. The seal at the top of the expandable casing permits pressurization of the volume between the drill string with the expandable casing. Seals 301, shown in FIG. 3 hold the pressure between drill string 225 and the expandable casing 101 at the lower end. Downward pressure for downward expansion is thereby applied across the whole internal cross section area of the unexpanded expandable casing, due to pressure differential across flapper valve and drill string in addition to pressure differential across seals 301. This downward pressure forces the duplex cone to the position shown in FIGS. 8A and 8B.

Figures 8A, 8B:
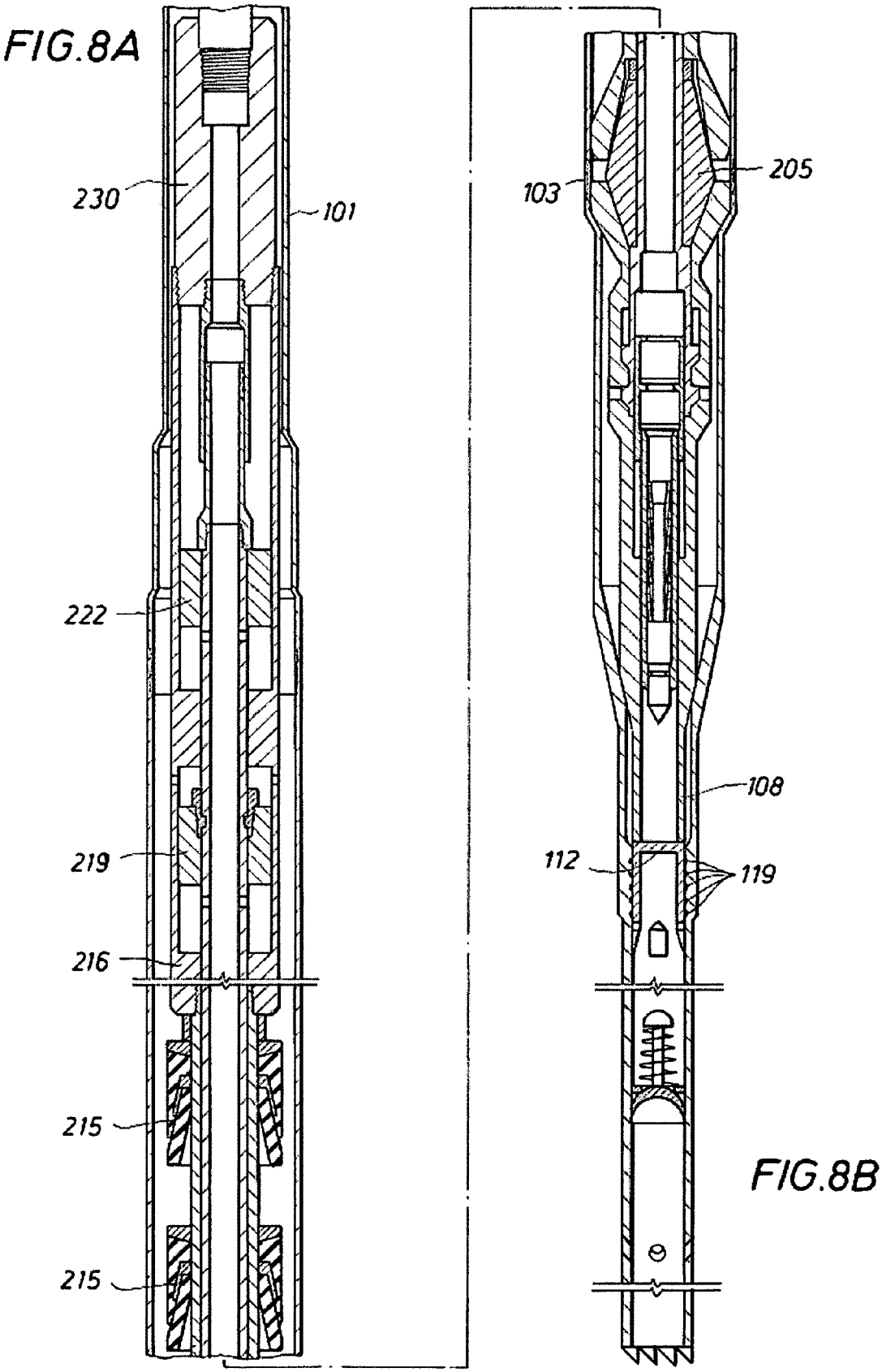
FIGS. 8A and 8B are partial cross sectional views of an expandable casing and an expanded duplex expansion cone within the expandable casing, after the duplex cone has been hydraulically forced to the cement shoe of the expandable casing.

Referring now to FIGS. 8A and 8B, the nose of the lower cone 108 has forced the sliding valve 112 into a closed position, providing a positive seal at the bottom of the expandable casing. Seals such as o-rings 119 help maintain a positive seal. Snap ring 113, shown in FIG. 1, is sheared by the force of the downward movement of the duplex cone assembly thereby allowing the sliding valve to move downward. Dimensions of the nose of the lower cone and the cement shoe are selected so that in the resting position at the bottom of the well, the lower expansion cone has expanded the expandable casing 101 to the bottom of the expandable casing through threaded joint 103 so that only millable or drillable material remains below the expanded portion of the casing.

Figures 9A, 9B:
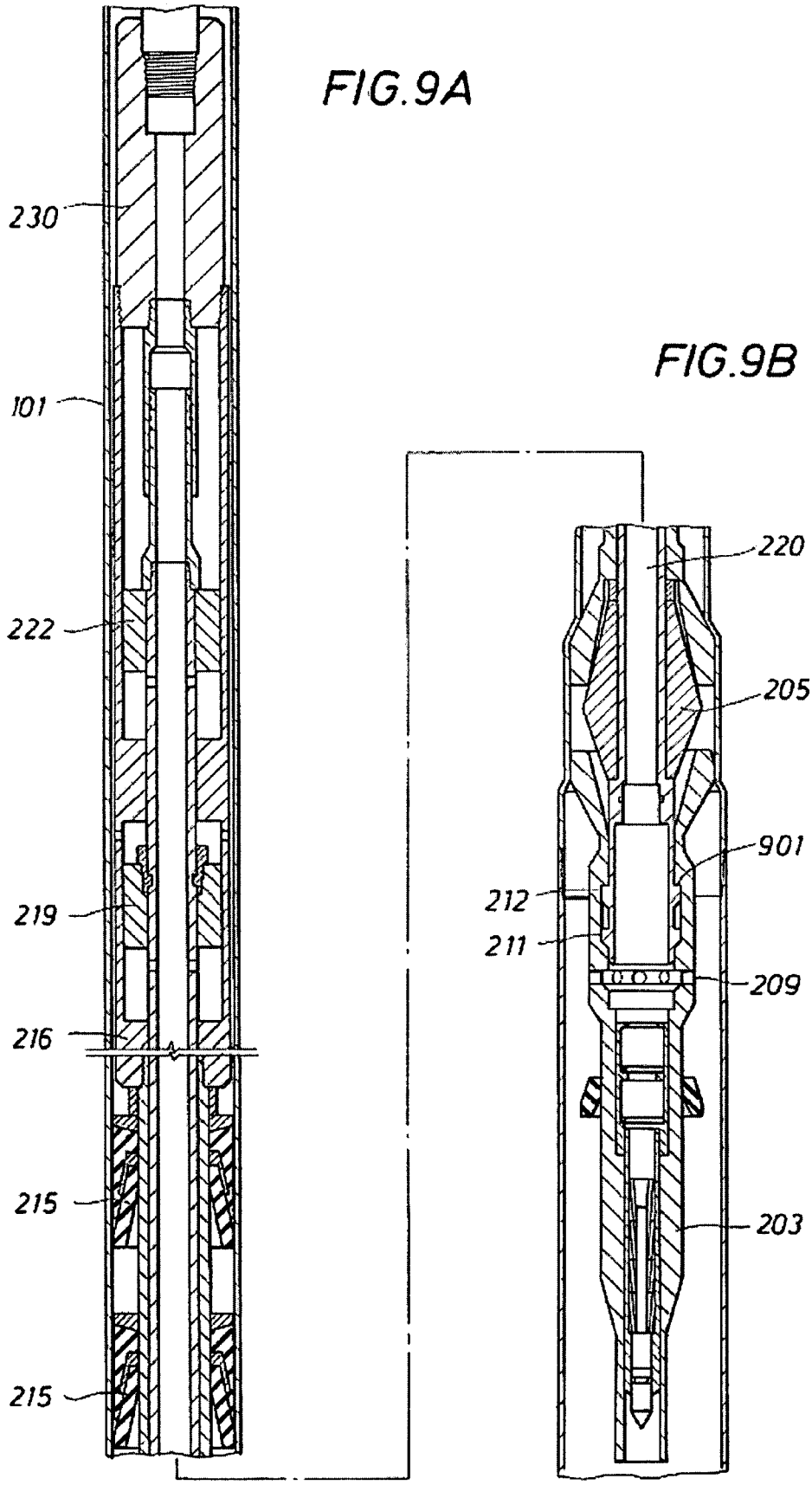
FIGS. 9A and 9B are partial cross sectional views of an expandable casing and an expanded duplex expansion cone within the expandable casing, after the duplex cone has been prepared for upward expansion of the remainder of the expandable casing.

Referring to FIGS. 9A and 9B, the duplex cone configured for upward expansion is shown. To configure the duplex cone for upward expansion, the lower cone 203 is slid down the expansion die 205 so that it outer diameter is equal to or less than the outer diameter of the upper cone when the upper cone is engaged with the expansion die. The lower cone 203 was therefore able to expand the lower portion of the expandable casing to a diameter that is, for example, about a half of an inch greater than the diameter to which the rest of the expandable casing will be expanded. This forms a bell at the bottom of the casing into which a next lower casing section may be expanded after the next lower segment of the well is drilled.

The embodiment shown provides for movement of the lower cone to an unexpanded position by movement of the flapper valve assembly to a second position. The diameter of the duplex expansion apparatus is thereby changed from a larger diameter to a slightly lesser diameter to provide for expansion of the remainder of the casing to a less expanded state than the bell portion of the casing. Movement of the lower cone is provided by over pressuring the fluids within the flow path to a selected pressure greater than that used for the downward expansion. This pressure is selected to be high enough to shear a shear pin or snap ring holding the flapper valve assembly in the earlier position. For example, if the downward expansion is performed at a pressure of 5000 psia, an over pressure to 5500 psia may be selected to move the flapper valve assembly to the final position. The movement of the flapper valve assembly does two things. First, it uncovers lower cone ports 209, allowing fluid communication between the inside of the drill string and the volume inside the expandable casing and outside of the duplex cone assembly. The second thing movement of the flapper assembly does is to remove inward support for the first dogs 211. The first dogs are supported on fingers extending from a cylinder section of the assembly mandrel. The fingers are flexible enough to bend inward when the support of the flapper assembly is removed. The inward movement of the first dogs can be improved by providing that the surfaces between the dogs and the lower cone rest are at a slight angle from normal to the centreline of the duplex cone apparatus. Further, the fluid pressure within the flow path will exert a force on the lower cone tending to urge the lower cone away from the assembly mandrel. When the first dogs are disengaged, the second dogs 212 will catch support surfaces 901 to permit recovery from the wellbore of the lower cone with the rest of the duplex cone assembly.

Figure 10:
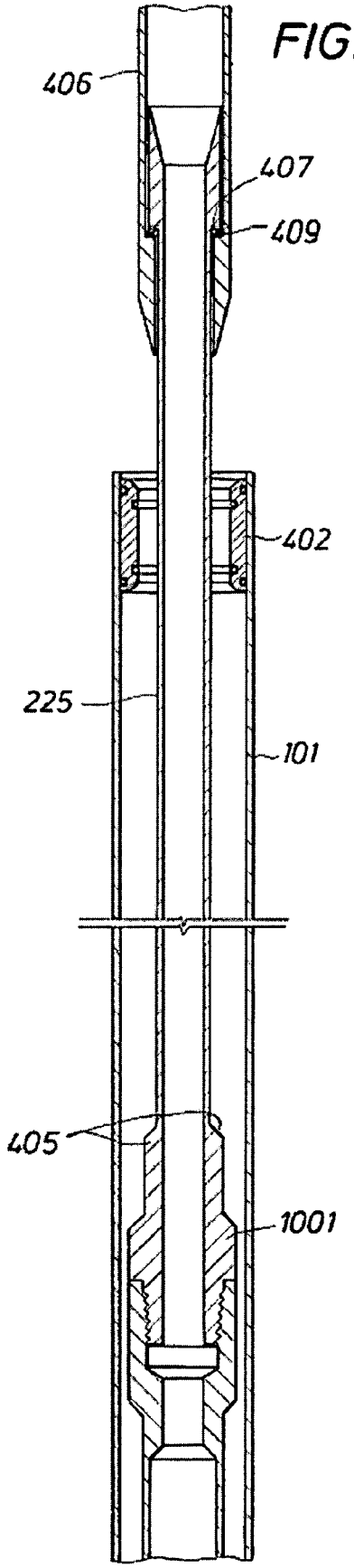
FIG. 10 is a partial cross sectional view of a top end of an expandable casing and an upper sealing assembly set in a position for upward expansion by the duplex cone.

Referring now to FIG. 10, the top end of the expandable casing is shown configured for upward expansion of the expandable casing 101. For upward expansion of the expandable casing, the slidable section 406 is pulled back upward to engage the slidable section shoulder 407 with the flow path seal 409. Thus the drill string and the flow path are connected and isolated from the wellbore outside of the drill string above the upward expansion sealing assemblies 215. As the drill string is raised along with upward movement of the duplex expansion cone, the first tool joint to contact the bushing 402 will remove the bushing so it will not block removal of the remainder of the duplex cone apparatus. The first tool joint may include a fin, or a plurality of fins 405 (two opposing fins shown) which will catch on slots in bushing 402 to allow engagement with the bushing, and rotation of the bushing to a position from which it may be removed from the top of the expandable casing.

Figure 11:
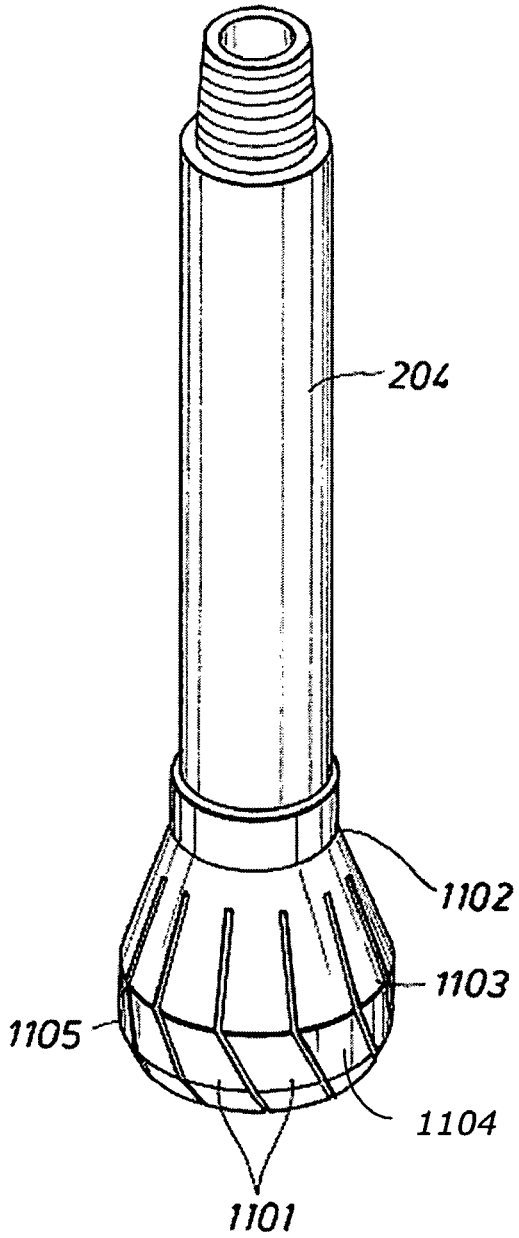
FIG. 11 is an isometric view of an upward expansion cone.

Referring now to FIG. 11, the upper expansion cone 204 is shown. The expandable cone section is divided into a plurality of deformable segments 1101 extending from base 1102. The base has a smaller diameter than the initial inside diameter of the casing. Each of the deformable segments includes a deformable portion 1103 and an expansion surface 1104 which contacts the casing during an expansion process. In the embodiment shown, the segments are angular to the centreline of the cone over the expansion surface 1105. The expansion surface is the surface that contacts the inner surface of the expandable casing during expansion. In the deformable portions of the deformable segments, the segments may be aligned with the centreline of the expandable mandrel. With the expansion surfaces aligned at an angle to the centreline of the expandable mandrel, the resulting expanded casing is expanded to a round shape. If the segments were aligned with the centerline of the cone, pipe expanded by the cone would have small ridges like rifling on the inside of the expanded pipe. This would be caused by gaps that would be formed when the deformable segments are deformed to the expanded diameter of the expandable mandrel. When the gaps resulting from the expansion of the cone over the expansion die are at an angle relative to the centerline of the apparatus (for example, between five and fifteen degrees from parallel to the centerline of the apparatus) the cone will expand the casing more evenly than it would with deformable segments. This more even expansion, or expansion to a more perfect circular cross section, is desirable. The deformable segments are, for example, deformed when the cone is pressed over the expansion die, so that the cone will partially retake its original form when force holding the cone onto the die is removed, or at least be readily bent back to the smaller diameter with a small amount of pressure so that the lower cone may be passed through the upper portion of the expanded casing which has not been expanded to as large of an internal diameter as the expanded lower cone and other forces applied.

Figure 12:
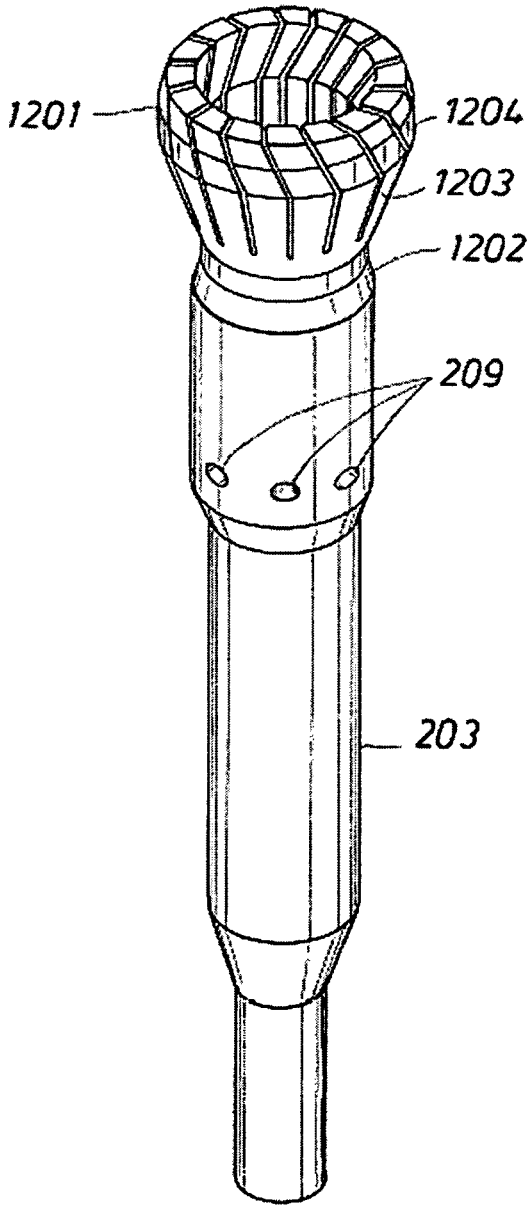
FIG. 12 is an isometric view of a downward expansion cone.

Referring now to FIG. 12, the lower expansion cone 203 is shown. The lower expansion cone is similar to the upper expansion cone in operation. Lower cone segments 1201 extend from lower cone base 1202 to form segments that can expand outward when the lower cone is forced over an expansion die. Each of the deformable segments includes a deformable portion 1203 and an expansion surface 1204 which contacts the casing during an expansion process. Lower cone ports 209 provide communication for fluids from within the flow path to outside of the duplex cone for upward expansion.

Figure 13:
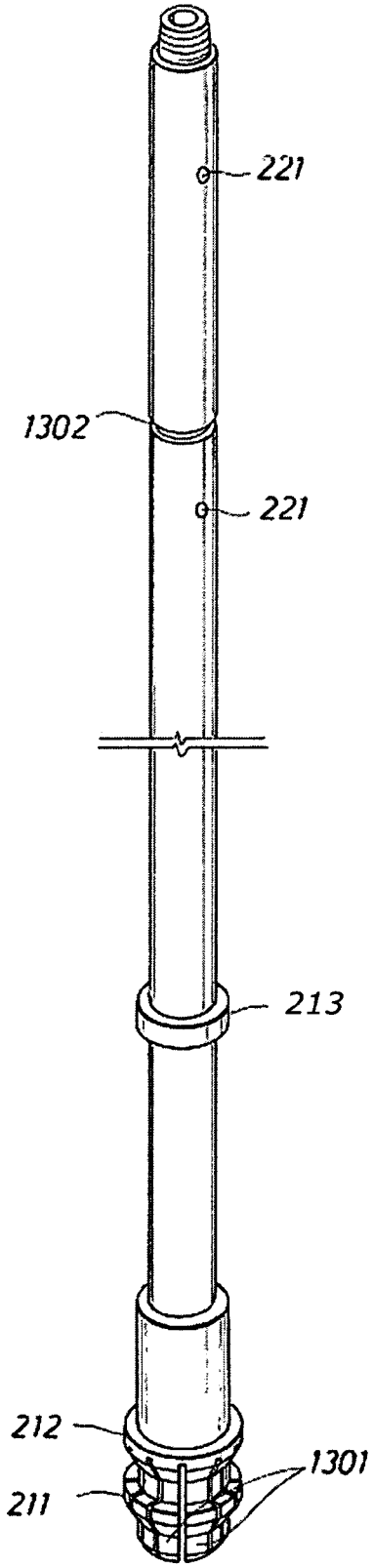
FIG. 13 is an isometric view of a mandrel for expanding a duplex cone.

Referring now to FIG. 13, the assembly mandrel is shown. First dogs 211 and second dogs 212 are shown with the first dogs on fingers 1301. Depression 1302 for holding retainer tie 223, and vent ports 221 are shown for the piston section of the mandrel. Spacer 213, separating the expansion die from the upper cone is shown. Retainer tie 223 may be attached to the assembly mandrel, or may be fabricated as a part of the assembly mandrel.

Figure 14:
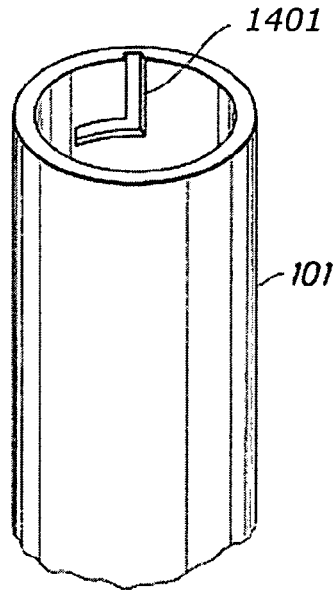
FIG. 14 is an isometric view of an upper seal bushing.
Figure 15:
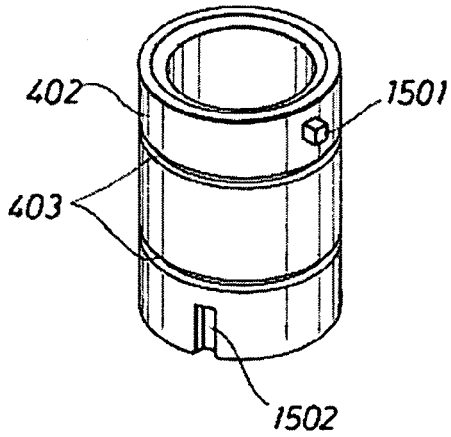
FIG. 15 is an isometric view of a retrieving tool within which an upper seal bushing may be retrieved.

Referring now to FIG. 14, the upper end of the expandable casing 101 is shown with a j-hook notch 1401 for securing the bushing. FIG. 15 shows the bushing 402 with a load pin 1501 suitable for engagement into the j-hook notch of FIG. 14. Casing seals 403 provide for sealing between the bushing 402 and the expandable casing 101.

Referring now to FIG. 15, bushing 402 is shown with key slot 1502 providing for engagement with a fin 405 attached to the first tool joint below the bushing. The fin 405 will catch in the key slot 1502, and continued rotation of the drill string will move the load pin 1501 to the vertical section of the j-hook notch in the expandable casing 101. Continued upward force may lift the bushing from the upper end of the expandable casing. Load pin 1501 may be held in the horizontal portion of the j-hook notch 1401 by action of a shear pin. The shear pin may be failed by torque applied through the fin 405.

What is claimed:

1. A duplex expansion apparatus for expanding a wellbore tubular to two different diameters from an initial internal diameter, the duplex expansion apparatus comprising:

a first diameter expansion cone that is, in a relaxed state, of a diameter less than the initial internal diameter and in an expanded state of a diameter greater than the initial internal diameter;

a second diameter expansion cone that is, in a relaxed state, of a diameter less than the initial internal diameter and in an expanded state of a diameter greater than the diameter of the first diameter expansion cone in the expanded state; and an assembly mandrel that is capable of transferring both the first diameter expansion cone and the second diameter expansion cone into their expanded states;

wherein the first diameter expansion cone and the second diameter expansion cone each comprises:

a base having an outside diameter smaller than the initial internal diameter; and a plurality of deformable segments extending from the base wherein each of the plastically deformable segments are deformable to an expanded internal diameter and when deformed to the expanded internal diameter together form an expansion surface having gaps between the deformed segments that are not aligned with a centerline of the tubular.

2. The duplex expansion apparatus of claim 1 further comprising an expansion die having a first diameter expansion surface and a second diameter expansion surface wherein the diameter of the first diameter is less than the diameter of the second diameter expansion surface.

3. The duplex expansion apparatus of claim 1 wherein the mandrel acts upon the first diameter expansion cone and the second diameter expansion cone by hydraulic pressure applied on at least one piston to press the first diameter expansion cone and the second diameter expansion cone over an expansion die.

4. The duplex expansion apparatus of claim 2 wherein the first diameter expansion cone and the second diameter expansion cone deform into their expanded states when pressed over the expansion die.

5. The duplex expansion apparatus of claim 1 wherein the expansion die comprises two ends, one end comprising a conical shape over which the first diameter expansion cone is pressed and a second end over which the second diameter expansion cone is pressed.

6. The duplex expansion apparatus of claim 1 further comprising a means for releasing the first diameter expansion cone from the expansion die while the second diameter expansion cone remains in the expanded state.

7. The duplex expansion apparatus of claim 1 wherein the expansion mandrel comprises a flow path through the expansion mandrel and the flow path further comprises a landing to seat a dart moving down the flow path to create a hydraulic pressure within the flow path for expansion of the duplex expansion apparatus to the expanded state.

8. The duplex expansion apparatus of claim 7 further comprising a second seal to seal the flow path upon the dart seating in the landing.

9. The duplex expansion apparatus of claim 8 wherein the second seal comprises at least one flapper valve.

10. The duplex expansion apparatus of claim 8 wherein the second seal comprises a plurality of flapper valves.

11. The duplex expansion apparatus of claim 8 wherein the second seal comprises a seating surface that, prior to the dart seating in the landing, is not exposed to flow through the flow path.

12. The duplex expansion apparatus of claim 1 wherein the deformable segments each comprise a deformable portion connecting to the base and connected to the expansion surface of the deformable segment.

13. The duplex expansion apparatus of claim 12 wherein the deformable portions are each aligned with the centreline of the tubular.

14. The duplex expansion apparatus of claim 13 wherein the collar is a cylindrically shaped metal section.

15. The duplex expansion apparatus of claim 12 wherein the expansion surface of the deformable segments form an essentially conical expansion surface.

16. The duplex expansion apparatus of claim 12 wherein the deformable portions extend outward from the centreline of the expandable mandrel.

17. The duplex expansion apparatus of claim 1 wherein the gaps are essentially formed by the outward expansion of the deformable segments.

* * * * *